US007775173B2

(12) United States Patent
Santarone

(10) Patent No.: US 7,775,173 B2
(45) Date of Patent: Aug. 17, 2010

(54) SAILBOAT RUDDER

(76) Inventor: Joel F. Santarone, 106 B. W. 33rd St., Boise, ID (US) 83714

( * ) Notice: Subject to any disclaimer, the term of this patent is extended or adjusted under 35 U.S.C. 154(b) by 308 days.

(21) Appl. No.: 11/934,653

(22) Filed: Nov. 2, 2007

(65) Prior Publication Data

US 2008/0105183 A1 May 8, 2008

Related U.S. Application Data

(60) Provisional application No. 60/856,418, filed on Nov. 3, 2006.

(51) Int. Cl.
*B63H 25/06* (2006.01)

(52) U.S. Cl. ..... 114/162

(58) Field of Classification Search ..... 114/162, 114/165, 167–169
See application file for complete search history.

(56) References Cited

U.S. PATENT DOCUMENTS 1,850,669 A 3/1932 Harvey
2,238,844 A * 4/1941 Arbeitlang ..... 244/50
2,991,749 A * 7/1961 Patterson ..... 114/132
3,921,561 A 11/1975 Arce
4,008,677 A 2/1977 Wordell, Sr.
4,211,180 A 7/1980 Brooks, Jr.
4,231,309 A 11/1980 Pelletier
4,711,192 A 12/1987 Kooy
5,447,113 A 9/1995 Chernin
2001/0027739 A1 10/2001 Simard et al.
2005/0039664 A1 2/2005 Arnold

* cited by examiner

*Primary Examiner*—Edwin Swinehart
(74) *Attorney, Agent, or Firm*—Robert L. Shaver; Dykas, Shaver & Nipper, LLP

(57) ABSTRACT

A rudder mechanism for use upon a sailboat is capable of being raised or lowered at the discretion of the boater using a single connected cable operating system, so that the system may be called a "one-pull" system for both raising and for lowering the rudder. The rudder is preferably pivotal, using the cable operating system, greater than 90 degrees, and more preferably, about 180 degrees. A self-contained gas cylinder may aid in the raising and lowering operation and to dampen and smooth the vertical, pivotal movement of the rudder. The cylinder also may be utilized to retain the rudder in a raised or lowered position, once the boater/sailor has purposely placed the rudder in that position, and to return the rudder to the fully-lowered position after grounding has temporarily "kicked-up" the rudder.

16 Claims, 3 Drawing Sheets

SAILBOAT RUDDER

CROSS-REFERENCE TO RELATED APPLICATIONS

This application claims the priority date of the provisional application entitled "Sailboat Rudder" filed by Joel F. Santarone on Nov. 3, 2006 with application Ser. No. 60/856,418.

FIELD OF THE INVENTION

The present invention relates generally to rudder and steering systems for water-born vessels and more particularly to rudder systems for sailboats, wherein the rudder is capable of being raised to a stowed position or lowered to a steering position as required. The preferred embodiment relates to transom-mounted (externally mounted), sailboat "kick-up" rudders that allow upward pivoting of a rudder upon grounding, to help protect the rudder and boat from damage.

BACKGROUND OF THE INVENTION

Sailing technology has existed for millennia and there are numerous variations on sailboat rudders. More specifically, there exist numerous sailboat rudders that are retractable in nature.

Retractable rudders are useful for passing a boat through shallow water in order to prevent the rudder from running aground and being damaged. Alternatively, if a rudder is retractable and it accidentally strikes a surface under water, the rudder may release upward from the downward position so that it is not damaged. Retractable rudders also enable the operator of the craft to lift the rudder from under the stern in order to place the boat on a trailer.

Often the design of such retractable rudders requires that the rudder be attached to a rope or other retraction means for manually retracting the rudder. In order to retract the rudder, the rope must be pulled and the rudder lifted from the water. This type of design is problematic for a number of reasons. The first reason being that the rudders are usually heavy and require significant strength and attention from the operator or crew of the sailboat to retract the rudder. Retracting the rudder may distract the operator or crew of the boat from other important duties or events occurring in the craft. A second reason that a conventional retractable rudder is problematic is that once the rudder is retracted it must be tied off or cleated so that it remains in the retracted position and does not drop back into the water. Cleating a retractable rudder takes additional time, effort, and attention of the operator or crew of the boat. Additionally, if a rudder is cleated and an urgent need for control of the craft arises, it takes a significant amount of time and effort to release the rudder back into the water. Due to the often rapid pace of events in a moving sailboat, any time saved may be crucial in preventing catastrophic errors.

Other retractable rudders that are known to the art are designed so if the sailboat runs into shallow water or the rudder strikes an underwater object, the rudder will kick up. However, this design may be problematic if the rudder is held by a friction mounting. A friction mounting allows a rudder that strikes an underwater object to yield to the underwater object, but the rudder will remain in a displaced or elevated position above or near the surface of the water. In order to move the rudder back into the water, an operator or crew member on the sailboat must manually push the rudder back into the water. This takes time and strength that may be needed in the craft. Additionally, if the rudder is stuck in an elevated position above or at the surface of the water the sailboat will have little or no control. A second problem may arise if the rudder is extended to the rearward from the transom or stern of the craft. In such a case, an increased amount of force is placed on the rudder mounting and the tiller arm when the rudder is in this position. If the rudder strikes an object or control of the boat is attempted with the rudder extended horizontally on the surface of the water, the force exerted on the rudder mounting may be great enough to tear the mounting from the transom of the sailboat or cause the tiller arm to fracture. Either of these events may cause catastrophic consequences because of loss of control of the sailboat.

SUMMARY OF THE INVENTION

The present invention relates generally to rudder systems used to steer water-born vessels, and more specifically, to rudder systems used on sailboats.

The preferred rudder system is designed to be pivotally mounted upon the transom of a vessel and provides a mechanism wherein the rudder may be raised to a secured position or lowered to an employed "steering" position as desired by the boater. The rudder may pivot greater than 90 degrees, and preferably approximately 180 degrees, between the steering position and secured position. The invented mechanism for raising and lowering the rudder may be called a "one-pull" system. A single pull of an uphaul line, such as a cord or cable, may be effective in raising the rudder to the secured position, and a single pull of the same uphaul line may be effective in lowering the rudder to the steering position. A pneumatic/gas cylinder or "strut" may be used to dampen the rudder movement between the steering and secured positions, may assist in raising and lowering the rudder, and may help retain the rudder in the desired position once the rudder has been raised or lowered.

The aforementioned rudder system is preferably constructed of suitably strong, lightweight, corrosion resistant, waterproof materials such as, but not limited to, plastics (polymers), stainless steel and aluminum. The preferred gas cylinder has a stainless steel housing.

The preferred embodiment is comprised of a generally vertical member, said member containing appropriate mounting bearings and fasteners for attachment to the vessel. Upon the lower end of the vertical member, a pivotal mounting structure is provided, wherein the rudder is installed. Protruding forwardly from and perpendicular to the upper end of the vertical member, a tiller bar is provided to rotate the vertical member and rudder to accomplish steering of the vessel. In alternative embodiments, the rudder system may be operatively connected to a steering wheel rather than a tiller bar.

To facilitate movement of the rudder from a secured, upright position to a lowered, "employed" or "steering" position, a cable and pulley system and gas cylinder are provided in the preferred embodiment wherein the boater may accomplish the desired movement using just one pull (for each of the lowering and the raising functions) and preferably just one hand. When the rudder is in the lowered, steering position, should the rudder inadvertently strike an underwater object, the aforementioned system allows rotational movement of the rudder sufficient to clear said underwater object, thereby preventing damage to the rudder, the preferred gas cylinder system provides a bias that returns the rudder to the employed position when the rudder is free from the underwater object.

The purpose of the foregoing Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the present invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

DESCRIPTION OF THE PREFERRED EMBODIMENTS

Figure 2:
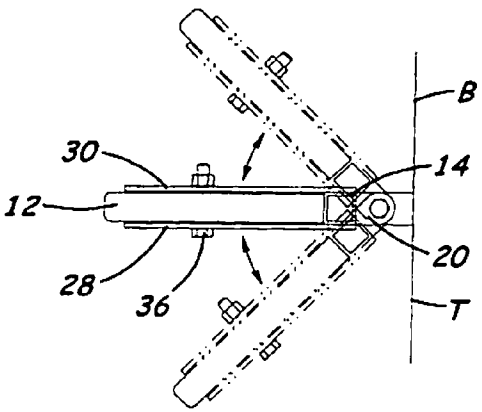
FIG. 2 is a partial top plan view of the embodiment of FIG. 1, viewed along line 2-2 in FIG. 1.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Until now, the boat industry has seen a long and unresolved need for a retractable rudder system that allows the operator of a boat to raise and lower a rudder with minimal effort and ease, while also allowing the rudder to have a security mechanism that allows the rudder to yield to underwater obstructions.

The present invention is a retractable sailboat rudder that is moveable from the up or secured position to the down or employed position or from the down to the up position with minimal effort. This functionality is accomplished by an uphaul line and pulley system coupled with a gas filled cylinder ("compressible resistance member"). The uphaul line is pulled to initiate both the upward and the downward movement, thereby improving the ease and simplicity of use over prior designs. Additionally, the gas filled cylinder both assists in the raising and lowering of the rudder and allows the rudder to yield to underwater obstructions that the rudder might strike while the boat is in motion. This functionality allows the rudder to raise as it contacts the object and automatically return to the steering position once the boat has passed the object.

In the following description and in the figures, like elements are identified with like reference numerals. The use of "or" indicates a non-exclusive alternative without limitation unless otherwise noted. The use of "including" means "including, but not limited to," unless otherwise noted.

Referring to the Figures, there are shown several, but not the only, embodiments of the invented rudder system used to steer a boat while underway upon water. The rudder system may be used on a boat during motor and/or sail and/or drifting, and may be adapted for use with a tiller arm and/or a steering wheel. Preferably, the invented rudder system is a transom-mounted system, but other mounting, construction, and installation systems may be used.

Figure 1:
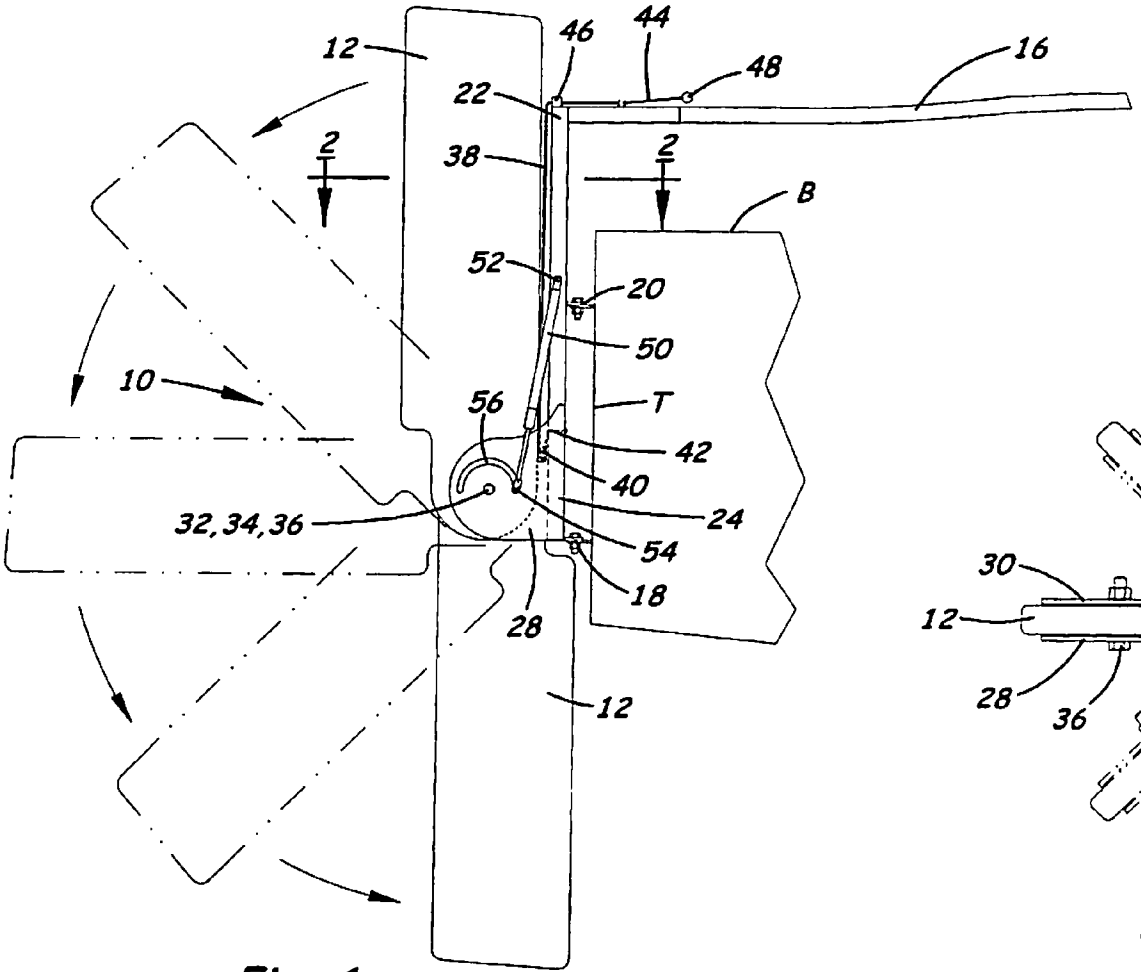
FIG. 1 is a side elevation view of one embodiment of the invented rudder system installed on a sailboat, showing in dot-dash lines the rudder pivoting between the raised ("secured" or "up") position and the lowered ("employed," "steering," or "down") position, according to one embodiment of the present invention.
Figure 4:
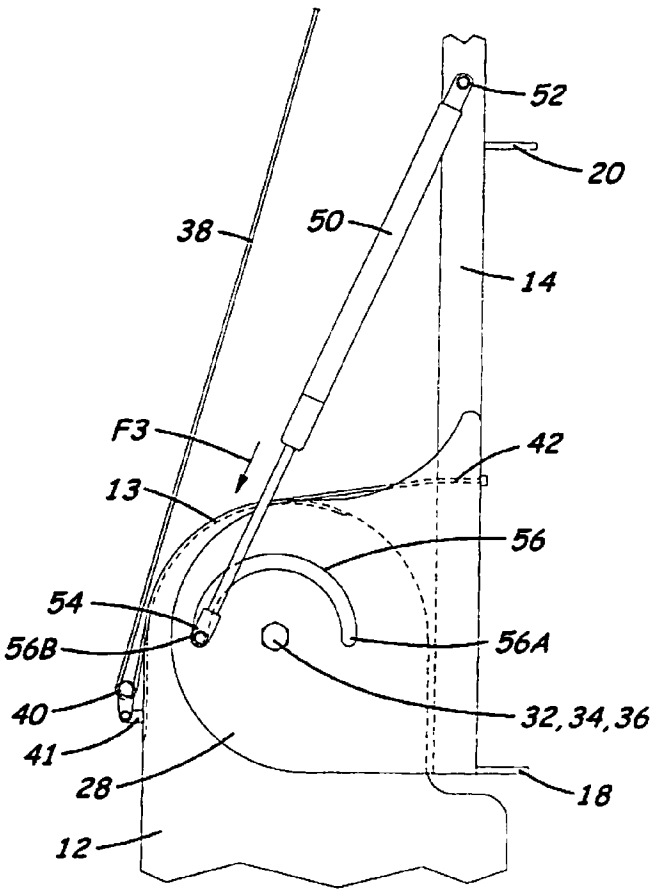
FIG. 4 is a partial side elevation view of the embodiment of FIGS. 1-3, illustrating the position of the components of the preferred "one-pull" system upon fully-lowering the rudder.
Figure 3:
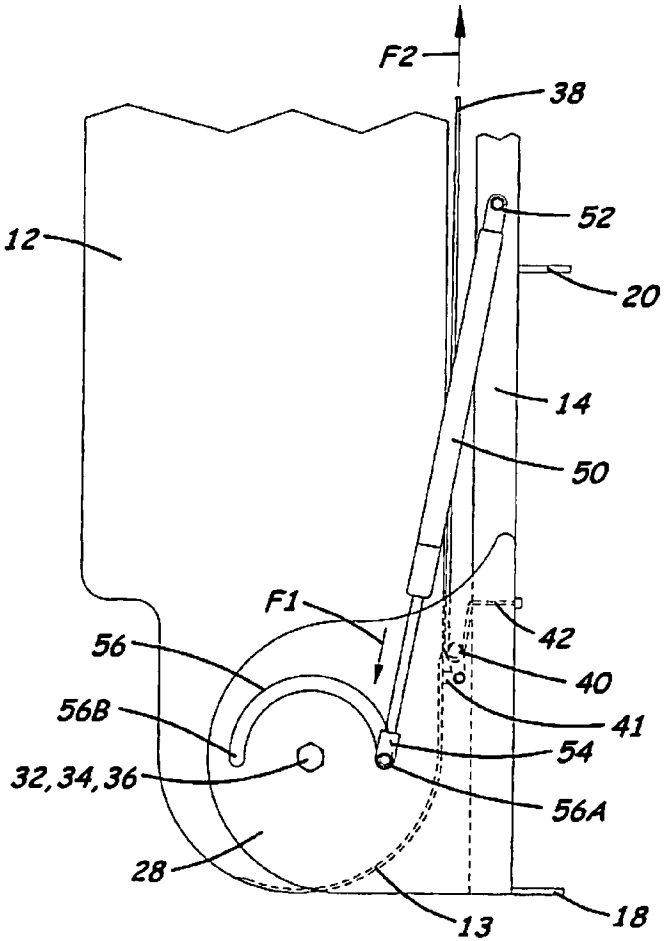
FIG. 3 is a partial side elevation view of the embodiment of FIGS. 1 and 2, illustrating the rudder in the raised position and illustrating, in more detail, one embodiment of the invented "one-pull" system.
Figure 6:
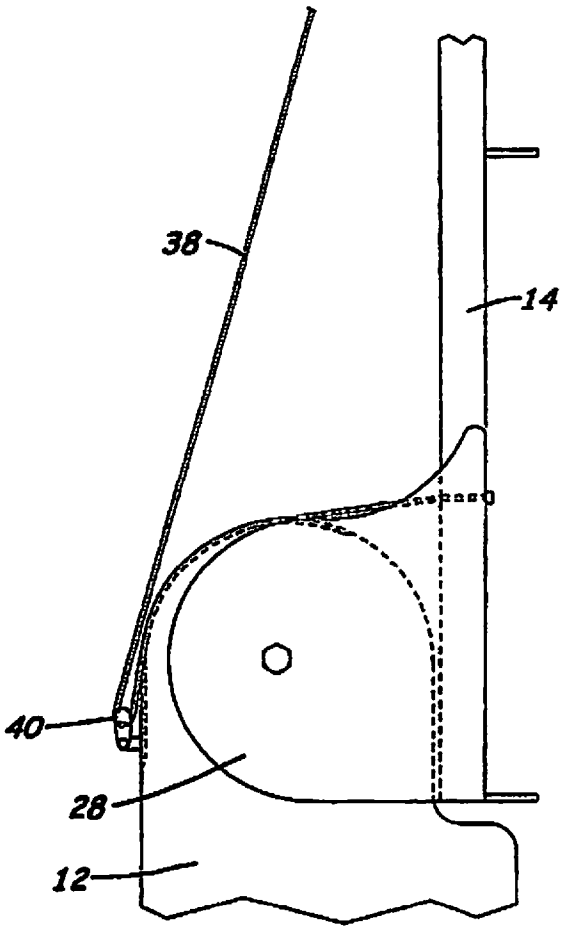
FIG. 6 is a partial side elevation view according to a third embodiment of the present invention, which does not comprise a gas cylinder as part of the raising and lowering system.
Figure 5:
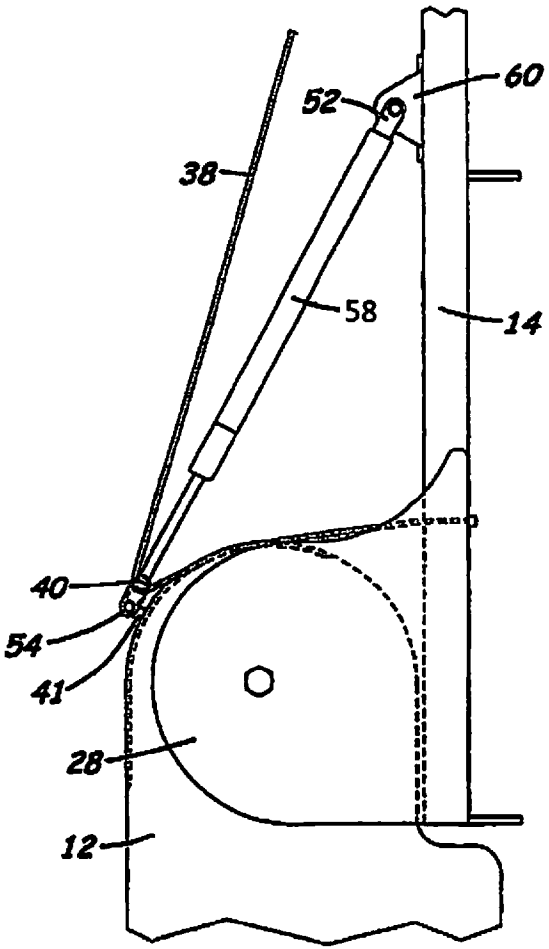
FIG. 5 is a partial side elevation view according to a second embodiment of the present invention, which comprises a different location for the gas cylinder.

FIGS. 1-6 illustrate three embodiments being lowered from a generally vertical raised position (for storage, securement during travel on a trailer over the road, or other reasons when the rudder is not in use) to a fully-lowered employed (again generally vertical) position. In FIG. 1, the uphaul line ("cable") and handle are resting on top of the tiller arm. FIG. 1 also illustrates multiple rudder positions during "one-pull" raising or lowering of the rudder. FIG. 3 shows the rudder in a fully raised or up position. FIGS. 4-6 show the rudder in the fully-lowered or down position.

FIG. 5 illustrates another embodiment, wherein this embodiment have a cylinder/strut connected to the rear edge of the post and to the edge of the rudder. FIG. 5 shows the rudder in the fully-lowered position, and show the strut in an extended condition.

FIG. 6 illustrates yet another embodiment being raised, wherein this embodiment does not use a cylinder/strut, and the raising and lowering of the rudder is done entirely by the force of the cable and pulley system. This embodiment is very similar to that in FIG. 6.

FIGS. 1-6 illustrate the "rudder head" ("one or more rudder brackets"), which may be extendible to different lengths by a telescoping or other system, and which may be mounted by simple, pivotal means to the transom.

Referring now to FIG. 1, it will be observed that the preferred rudder mechanism 10 is comprised generally of rudder 12, rudderpost 14 and tiller bar 16. Rudderpost 14 has, preferably permanently affixed upon its forward, vertical surface, mounting bearings 18 and 20 and associated fasteners, these being used to mount and secure the rudder system 10 to the transom T of boat B. Mounting bearings 18 and 20 can also be bearings in the boat hull and deck, through which the rudderposts extends. When rudder system 10 is so installed, the mounting fasteners are adjusted so that rudderpost 14 may rotate to the right or left with respect to transom T. (See FIG. 2). Mounted at the upper end 22 of rudderpost 14 and extending forwardly from and generally perpendicular to rudderpost 14 is tiller bar 16, used by the boater/sailor to rotate rudder system 10 to the right or left, thereby steering the boat to port or starboard while underway. Some boats may have a vertical transom, others may have an undercut or an overhanging transom, and the rudderpost generally is parallel to the transom of the boat. At the lower end 24 of rudderpost 14 are permanently mounted rudder brackets ("rudder head") 28 and 30, extending rearward from and perpendicular to rudderpost 14. Brackets 28 and 30 contain pivot holes 32 to correspond with pivot hole 34 in rudder 12, through which fastener 36 is inserted and secured, thereby pivotally mounting rudder 12 within rudder brackets 28 and 30. Fastener 36 may be adapted to be allow removal of the rudder for repair or replacement, and may be adapted to be adjustable, for example, adjusting the compression of the rudder brackets 28, 30 on the rudder 12 or otherwise adjusting the tightness of the pivotal mounting of the rudder. Thusly mounted, rudder 12 is free to pivot upwardly and downwardly through an arc of greater than 90 degrees, preferably 160 -200 degrees, and most preferably 180 degrees. Force exerted by the boater upon the uphaul line ("cable") 38, passing through pulley 40 affixed to rudder 12 with stud ("fastener") 41, is applied to raise or lower rudder 12. Pulley 40 is free to pivot about the outer end of stud 41. Cable 38 is fixed/immovable at its lower end 42 to rudderpost 14. Rudder 12, at its pivotal end ("first end"), contains within its edge portion, slot 13 to aid in maintaining alignment between cable 38 and rudder 12. Cable 38, at its upper end 44, passes through aligning eye 46, which is affixed to the upper end 22 of rudderpost 14. Also at upper end 44 of cable 38 is affixed handle 48, this being used by the boater to attain a firm grip upon cable 38 when it is desired that rudder 12 be pivoted.

Referring now to FIGS. 3 and 4, it will be seen that, mounted parallel to the vertical center plane of rudderpost 14 is gas cylinder ("compressible resistance member") 50, secured pivotally at its upper end ("first end") 52 to rudder post 14, and at its lower end ("second end") 54 within slot ("arched slot") 56 in bracket 28 and pivotally secured to rudder 12 near the top end ("first end") of rudder 12 and near a first edge of the rudder 12 (said first edge being the inner, front edge of the rudder when the rudder is in the raised position, as in FIG. 3). There gas cylinder 50, therefore, is generally in a plane parallel to, but offset to one side of the plane of the rudder.

Operation of the rudder system 10 will now be discussed, beginning with the rudder 12 in the upright, secured position.

Referring now to FIG. 3, it will be noted that the lower end 54 of gas cylinder 50 resides at end 56A("first lower slot position") of slot 56, specifically, with lower end 54 or, more typically, the fastener ("connection piece") that connects the end 54 to the rudder, extending through the slot for connection to the rudder. Besides a gas cylinder, the compressible resistance member can be a gas filled cylinders, a piston, springs, compressible struts, or compressible elongate elastic material, or other compressible structures.

The force exerted downwardly by the pressure within gas cylinder 50 while in this position, indicated by arrow F1, tends to keep rudder 12 in the upright position. When the boater desires to lower the rudder 12, cable 38 at handle 48 is grasped and pulled toward the forward end of the boat. When sufficient force through cable 38 is exerted by the boater, indicated by arrow F2 (and which is applied by the cable 38 being pulled forward on the boat in view of the cable 38 changing directions via eye 46), the force F1 exerted by gas cylinder 50 is overcome. Force F2 acts upon pulley 40 affixed to rudder 12 with stud 41, in view of end 42 of cable 38 being fixed to rudderpost 14, to pivot the rudder outward.

As Force F2 pivots the rudder outward, lower end 54 of gas cylinder 50 then begins to move upwardly and rearwardly, sliding within slot 56, and rudder 12 rotates rearwardly and downwardly. Upon continued force F2, still exerted by the boater pulling forward on the handle 48, lower end 54 of gas cylinder 50 rotates through approximately 90 degrees of arc in slot 56, rudder 12 rotating a corresponding 90 degrees. Through this position, the gas cylinder 50 is being shortened, and Force F1 is working against the boater pulling on the handle/cable, but Force F2 overcomes F1 with the assistance of the pulley. Note that pulley 40, in FIGS. 3 and 4, because of its attachment point on the rudder, is below the cable attachment point (at 42) on rudderpost 14. Also, the rudderpost and cable may be adapted to adjust the attachment point for end 42 (raise or lower the attachment point on the post) to fit different rudders and to fit different users. Note also that the pulley is moveable during its use in the preferred system, and it moves generally upwards from its position in FIG. 3 as the cable 38 is pulled, or upwards from its position in FIG. 4 as the cable is pulled. Pulley 40 may be considered a moveable (Class 2) pulley, and offers a 2:1 force advantage; this has been found to be effective for raising many rudders, for example, those weighing about 20 pounds. Alternative pulley systems, including more than one pulley, may be used, but the simplicity of a single, moveable pulley is preferred.

Upon reaching the zenith ("intermediate zenith slot position") of slot 56 at approximately 90 degrees of rotation, the lower end 54 of gas cylinder 50 begins to travel downwardly in slot 56 (lengthening as it travels through the left half of the slot 56 in FIGS. 3 and 4) and gas cylinder 50 once again is able to apply downward force, indicated by arrow F3, upon lower end 54, whereupon lower end 54 is stopped at end ("second lower slot position") 56B of slot 56. Rudder 12 has now rotated through 180 degrees of arc, coming to rest at the lowered, steering position. The force F3 exerted by gas cylinder 50 tends to keep rudder 12 in the lowered position. It will be noted from FIG. 4 that a portion of cable 38 now resides in slot 13, thereby tending to keep cable 38 aligned with rudder 12.

While the boat is underway, should the rudder strike an underwater object such as rocks or a sand bar, the rudder 12 is free to rotate upwardly to clear said object, thereby preventing rudder damage. Upon clearing said object, the rudder 12 will automatically return to the fully lowered steering position, as it is biased into this position by the gas cylinder.

When the boater desires to return the rudder 12 to the upright, secured position, force is exerted by the boater forwardly through handle 48 and cable 38, thereby overcoming force exerted by gas cylinder 50 at F3. Lower end 54 of gas cylinder 50 begins travel upwardly and forwardly in slot 56 and rudder 12 begins rotation upwardly and forwardly. Having traveled through 180 degrees of arc (generally in the reverse of the description above) rudder 12 now resides in the up position and lower end 54 of gas cylinder 50 comes to rest at end 56A of slot 56, as shown in FIG. 3.

Thus, in both the lowering and raising of the rudder, the same cable 38 pulled the same direction is used to overcome the forces of the gas cylinder and/or the rudder weight, but once the gas cylinder lower end has moved over the "crest" of its rotation, it assists with the rudder movement into the desired position. Further, the gas cylinder provides a dampening effect, because of its bias (F1 and F3) so that the rudder movement is made smoother and does not tend to "slam" into either position. Alternative biasing means may be used, such as other cylinders or struts, springs, or elongated elastic members, but the gas cylinder is preferred because of its consistency of operation, its aesthetics, and its durability.

Referring now to FIG. 5, a second embodiment of the invented rudder system is shown wherein compressible strut 58 may be used interchangeably with gas cylinder 50 and is mounted so that its centerline lies in the same plane as that of rudderpost 14 and rudder 12. Bracket 60 is provided upon rudderpost 14 to pivotally mount upper end ("first end") 52 of gas cylinder 50. Lower end ("second end") 54 is pivotally mounted upon stud ("fastener") 41 utilizing the same fastener as that which mounts pulley 40, so that the lower end 54 may be mounted to the edge of the rudder ("first edge periphery of the first end of the rudder") (an outer, upper edge when the rudder is in the full-lowered position). It will be noted that in this embodiment, slot 56 has been removed from bracket 28, or at least is considered optional, as it is no longer required for movement of the lower end 54. Operating method and all other components remain substantially the same as those in the preferred embodiment, with the exception that, when the rudder is moving into the raised position, the lower end 54 moves close to the rudderpost 14 and, in effect, becomes hidden along with the pulley between the rudder edge and the post. This embodiment may be less preferred, because there may tend to some interference between the gas cylinder and the cable during raising or lowering of the rudder.

Referring now to FIG. 6, a third embodiment of the invented rudder system is shown wherein a gas cylinder is not used and completely manual manipulation of cable 38 is used to raise and lower rudder 12. This embodiment may certainly be effective, depending, for example, on the size and weight of the rudder and the characteristics of the mounting of the rudder in the rudder head (brackets 28 and 30). Operating method and all other components remain the same as those in the preferred embodiment, except that the gas cylinder is not available to assist as described above for the first and second embodiment.

Preferred embodiments of the invention, therefore, may be described as a system for raising a rudder more than 90 degrees from its employed position, and preferably approximately 180 degrees. The system for raising and lowered the rudder may be a one-pull, single line system, which does not require separate lines/cables for raising and for lowering the rudder. The preferred system utilizes a pulley and cable properly placed so that, when the rudder is already raised, pulling on the cable pivots the rudder outward and downward, and so that, when the rudder is already lowered, pulling on the same cable preferably in the same direction pivots the rudder upward and inward. This provides and comfortable, easy to operate, and one may even say elegant, apparatus and method of controlling the level and position of the rudder. Further, in transom-mounted embodiments, the post and its system for connection to the boat may be easily adapted for different sizes, styles, and types of boats.

The preferred embodiments may be described as a manually-raised and manually-lowered rudder system, which preferably includes a cylinder (piston) but most preferably only a self-contained cylinder/piston (rather than one that is powered or controlled by a separate fluid, gas, or other actuation system). The simple and effective one-pull cable/pulley system preferably utilizes a single cable and a single pulley, so that a single cable extends from a handle, around a single pulley, and then to an anchor point. This may be differentiated from a complex cable system, with multiple cables and multiple cable portions extending many different directions and/or having multiple handles.

Although this invention has been described above with reference to particular means, materials, and embodiments, it is to be understood that the invention is not limited to these disclosed particulars, but extends instead to all equivalents within the scope of the Description, Drawings, and Photographs.

The exemplary embodiments shown in the figures and described above illustrate but do not limit the invention. It should be understood that there is no intention to limit the invention to the specific form disclosed; rather, the invention is to cover all modifications, alternative constructions, and equivalents falling within the spirit and scope of the invention as defined in the claims. While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A retractable boat rudder system for a boat, said boat comprising a hull with a bow or forward portion, stern or rearward portion, transom, and steering interface said retractable rudder system comprising:

a rudder with a first end and a second end, said rudder comprised of an elongate planar member containing a pivot hole in the first end of said rudder; said rudder having a first edge and a second edge; said first edge facing rearward from said boat and said second edge facing forward and adjacent to said hull of said boat when rudder resides in a generally down position;

one or more mounting bearings, said mounting bearings configured to attach to said boat with fasteners;

a rudderpost, said rudderpost oriented generally parallel to said transom of said boat, said rudderpost attached to said one or more mounting bearings, said mounting bearings allowing a left and right motion of said rudderpost with said rudderpost attached to said steering interface;

one or more rudder brackets attached to said rudder post, said one or more rudder brackets extending generally rearward, said one or more rudder brackets having pivot holes corresponding to said pivot hole of said rudder;

a fastener passing through said pivot hole of one or more said rudder brackets and said pivot hole in said rudder such that rudder is mounted to said rudder brackets and free to rotate in a plane parallel to a plane of said one or more said rudder brackets;

an uphaul line, an upper end of said uphaul line passing from a top end rudderpost, down said rudderpost, through a pulley fixed to a first edge periphery of said first end of said rudder, and a lower end of said uphaul line being fixed to said rudderpost;

at least one compressible resistance members, a first end of said at least one compressible resistance members attached to said rudderpost and a second end of said at least one compressible resistance members attached to said first end of said rudder;

wherein said rudder is configured to move between a said generally down position and a generally up position, with said at least one compressible resistance members configured to push said rudder down in said generally down position and to hold said rudder up in said generally up position.

2. The retractable boat rudder system for a boat of claim 1 in which said first end of said rudder is comprised of a generally arcuate profile.

3. The retractable boat rudder system for a boat of claim 1 in which said at least one compressible resistance members are mounted generally parallel to or within the plane of said rudder and said rudder post.

4. The retractable boat rudder system of claim 1 in which said steering interface comprises a tiller arm.

5. The retractable boat rudder system of claim 1 in which said at least one compressible resistance members comprises gas filled cylinders/pistons.

6. The retractable boat rudder system of claim 1 in which said at least one compressible resistance members comprises compressible struts.

7. The retractable boat rudder system of claim 1 in which movement of said rudder from said generally up position to said generally down position or movement from said generally down position to said generally up position requires pulling said uphaul line.

8. The retractable boat rudder system of claim 1 in which an upper half of said one or more rudder brackets contain an arched slot; the second end of said at least one compressible resistance members attach to said rudder through said arched slot so that said at least one compressible resistance members are generally parallel to the plane of the rudder.

9. The retractable rudder system of claim 8 in which said second end of said at least one compressible resistance members attach with a connection piece to said rudder through said arched slot.

10. The retractable boat rudder system of claim 8 in which said arched slot in said one or more rudder brackets is comprised of first and second lower slot positions and an intermediate zenith slot position between said first and second lower slot positions; said first lower slot position being nearest a connection between said one or more rudder brackets and said rudderpost and said second lower slot position being nearest the rearward edge of said one or more rudder brackets; said intermediate zenith slot position nearest the upper edge of said rudder bracket above said pivot hole in said one or more rudder brackets; wherein said connection piece, joining said second end of said at least one compressible resistance members to said first end of said rudder, rests in said first lower slot position of said arched slot when said rudder is in said generally up position, and said connection piece rests in said second lower slot position of said arched slot when said rudder is in said generally down position;

said uphaul line configured to cause rotation of said rudder from said generally up position to an intermediate and generally horizontal position; this movement causes said connection piece, joining said second end of said at least one compressible resistance members to said first end of said rudder, to slide from said first lower slot position to said intermediate zenith slot position within said arched slot; this motion requires compression of one or more said compression resistance members as said connection piece rises within said arched slot from said first lower slot position to said intermediate zenith slot position;

wherein movement of said rudder from said intermediate and generally horizontal position to a said generally down position, causes said connection piece attached to said second end of said at least one compressible resistance members to slide within said arched slot from said intermediate zenith slot position to said second lower slot position; this motion forcibly caused by de-compression of one or more said compression resistance members;

wherein pulling said uphaul line causes rotation of said rudder from said generally down position to said intermediate and generally horizontal position; this movement causes said connection piece attached to said second end of said at least one compressible resistance members to slide within said arched slot from said second lower slot position to said intermediate zenith slot position; this motion requires compression of one or more said compression resistance members as said connection piece attached to said second end of one or more said compression resistance members rises from said second lower slot position to said intermediate zenith slot position;

wherein movement of said rudder from said intermediate and generally horizontal position to a said generally up position, causes said connection piece attached to said second end of said one or more said compressible resistance members to slide within said arched slot from said intermediate zenith slot position to said first lower slot position; this motion forcibly caused by de-compression of said compression resistance member.

11. The retractable boat rudder system of claim 1 in which one or more said compression resistance members are attached generally within the same plane as the rudder, the second end of said at least one compressible resistance members is attached to said first edge periphery of said first end of said rudder.

12. The retractable boat rudder system of claim 11 wherein said uphaul line passes from the top of said rudder post and extends generally parallel and above said at least one compressible resistance members, said uphaul line passes through said pulley, said uphaul line passes along periphery of said first end of said rudder, and said lower end of said uphaul line is fixed to said rudderpost;

wherein said second end of said at least one compressible resistance members is attached to said first edge periphery of said first end of said rudder such that said second end of said at least one compressible resistance members is oriented generally to a rearward position facing away from said hull of said boat when said rudder is in said generally down position;

wherein pulling said uphaul line causes rotation of said rudder from said generally down position to an intermediate and generally horizontal position; this movement causes said second end of said at least one compressible resistance members attached to said first edge periphery of said first end of said rudder to rise from a rearward position facing away from said hull of said boat to an intermediate zenith position; said intermediate zenith position generally directly above said fastener on which said rudder pivots; wherein this motion, causing the rudder to move from said generally down to said intermediate and generally horizontal position requires compression of one or more said compression resistance members as said second end of one or more compression resistance members rises from said rearward facing position to said intermediate zenith position;

wherein movement of said rudder from said intermediate and generally horizontal position to said generally up position, causes said second end of said at least one compressible resistance members attached to said first edge periphery of said first end of said rudder to drop from said intermediate zenith position to a forward facing position between said first end of said rudder and said hull of said boat, this movement caused by decompression of said at least one compressible resistance members;

wherein pulling said uphaul line causes rotation of said rudder from said generally up position to said intermediate and generally horizontal position; this movement causes said second end of said at least one compressible resistance members attached to said first edge periphery of said first end of said rudder to rise from said forward facing position between said first end of said rudder and said hull of said boat to said intermediate zenith position; said intermediate zenith position generally directly above said fastener on which said rudder pivots; wherein this motion, causing the rudder to move from said generally up position to said intermediate and generally horizontal position requires compression of one or more said compression resistance members as said second end of one or more compression resistance members rises from said forward position between said first end of said rudder and said hull of said boat to said intermediate zenith position directly above said fastener on which said rudder pivots;

wherein movement of said rudder from said intermediate and generally horizontal position to said generally down position, causes said second end of said at least one compressible resistance members attached to said first edge periphery of said first end of said rudder to drop from said intermediate zenith position to said rearward position facing away from said hull of said boat, this movement caused by decompression of said at least one compressible resistance members.

13. The retractable boat rudder system of claim 1 wherein mounting of said retractable rudder system may be facilitated on either said rearward or said forward portions of said boat.

14. A retractable boat rudder system for a boat, said boat comprising a hull with a bow or forward portion, stern or rearward portion, transom, and steering interface said retractable rudder system comprising:

a rudder with a first end and a second end, said rudder comprised of an elongate planar member containing a pivot hole in the first end of said rudder; said rudder having a first edge and a second edge; said first edge facing rearward from said boat and said second edge facing forward and adjacent to said hull of said boat when said rudder resides in a generally down position;

one or more mounting bearings, said mounting bearings configured to attach to said boat with fasteners;

a rudderpost, said rudderpost oriented generally parallel to the transom of said boat, said mounting bearings allowing a left and right motion of said rudderpost with said rudderpost attached to said steering interface;

one or more of rudder brackets attached to said rudder post, said one or more rudder brackets extending generally rearward, said one or more rudder brackets having pivot holes corresponding to said pivot hole of said rudder;

a fastener passing through said pivot hole of one or more said rudder brackets and said pivot hole in said rudder such that rudder is mounted to said rudder brackets and free to rotate in a plane parallel to a plane of said one or more said rudder brackets;

an uphaul line, an upper end of said uphaul line passing from a top end rudderpost, down said rudderpost, through a pulley fixed to a first edge periphery of said first end of said rudder, and a lower end of said uphaul line being fixed to said rudderpost;

at least one compressible resistance members, a first end of said at least one compressible resistance members attached to said rudderpost and a second end of said at least one compressible resistance members attached to said first end of said rudder; said one or more rudder brackets contain an arched slot; the second end of said at least one compressible resistance members attach to said rudder through said arched slot with a connection, wherein said rudder is configured to move between a said generally down position and a generally up position, with said at least one compressible resistance members configured to push said rudder down in said generally down position and to hold said rudder up in said generally up position;

wherein movement of said rudder from said generally up position to said generally down position or movement from said generally down position to said generally up position is accomplished by pulling on said uphaul line;

wherein said arched slot in said one or more rudder brackets is comprised of first and second lower slot positions and an intermediate zenith slot position between said first and second lower slot positions; said first lower slot position being nearest a connection between said one or more rudder brackets and said rudderpost and said second lower slot position being nearest the rearward edge of said one or more rudder brackets; said intermediate zenith slot position nearest the upper edge of said rudder bracket and above said pivot hole in said rudder bracket;

wherein said connection piece, joining said second end of said at least one compressible resistance members to said first end of said rudder, rests in said first lower slot position of said arched slot when said rudder is in said generally up position, and said connection piece rests in said second lower slot position of said arched slot when said rudder is in said generally down position;

wherein pulling said uphaul line causes rotation of said rudder from said generally up position to an intermediate and generally horizontal position; this movement causes said connection piece, joining said second end of said at least one compressible resistance members to said first end of said rudder, to slide from said first lower slot position to said intermediate zenith slot position within said arched slot; this motion requires compression of one or more said compression resistance members as said connection piece rises within said arched slot from said first lower slot position to said intermediate zenith slot position;

wherein movement of said rudder from said intermediate and generally horizontal position to a said generally down position, causes said connection piece, joining said second end of said at least one compressible resistance members to said first end of said rudder, to slide within said arched slot from said intermediate zenith slot position to said second lower slot position; this motion forcibly caused by de-compression of one or more said compression resistance members;

wherein pulling said uphaul line causes rotation of said rudder from said generally down position to said intermediate and generally horizontal position; this movement causes said connection piece, joining said second end of said at least one compressible resistance members to said first end of said rudder, to slide within said arched slot from said second lower slot position to said intermediate zenith slot position; this motion requires compression of one or more said compression resistance members as said connection piece rises from said second lower slot position to said intermediate zenith slot position;

wherein movement of said rudder from said intermediate and generally horizontal position to a said generally up position, causes said connection piece, joining said second end of said at least one compressible resistance members to said first end of said rudder, to slide within said arched slot from said intermediate zenith slot position to said first lower slot position; this motion forcibly caused by de-compression of said compression resistance member;

wherein mounting of said retractable rudder system may be facilitated on either said rearward or said forward portions of said boat.

15. A retractable boat rudder system for a boat, said boat comprising a hull with a bow or forward portion, stern or rearward, transom, and steering said retractable rudder system comprising:

a rudder with a first end and a second end, said rudder comprised of an elongate planar member containing a pivot hole in the first end of said rudder; said rudder having a first edge and a second edge; said first edge facing rearward from said boat and said second edge facing forward and adjacent to said hull of said boat when rudder resides in a generally down position;

one or more mounting bearings, said mounting bearings configured to attach to said boat with fasteners;

a rudderpost, said rudderpost oriented generally parallel to the transom of said boat, a forward facing portion of said rudderpost attached to said one or more mounting bearings, said mounting bearings allowing a left and right motion of said rudderpost with said rudderpost attached to said steering interface;

one or more of rudder brackets attached to said rudder post, said one or more rudder brackets extending generally rearward, said one or more rudder brackets having pivot holes corresponding to said pivot hole of said rudder;

a fastener passing through said pivot hole of one or more said rudder brackets and said pivot hole in said rudder such that rudder is mounted to said rudder brackets and free to rotate in a plane parallel to a plane of said one or more said rudder brackets;

an uphaul line, an upper end of said uphaul line passing from a top end rudderpost, down said rudderpost, through a pulley fixed to a first edge periphery of said first end of said rudder, and a lower end of said uphaul line being fixed to said rudderpost;

at least one compressible resistance members, a first end of said at least one compressible resistance members attached to said rudderpost and a second end of said at least one compressible resistance members attached to said first end of said rudder; said at least one compressible resistance members are mounted generally within the plane of said rudder and said rudder post;

wherein said rudder is configured to move between a said generally down position and a generally up position, with said at least one compressible resistance members configured to push said rudder down in said generally down position and to hold said rudder up in said generally up position.

wherein movement of said rudder from said generally up position to said generally down position or movement from said generally down position to said generally up position requires pulling said uphaul line;

wherein said compression resistance members are attached generally within the same plane as the rudder, the second end of said at least one compressible resistance members is attached to the same fastener as said pulley which is fixed to the said first edge periphery of said first end of said rudder.

wherein said second end of said at least one compressible resistance members attached to said first edge periphery of said first end of said rudder adjacent to said pulley so that said uphaul line passes from the top of said rudder post and extends generally parallel and above said at least one compressible resistance members, said uphaul line passes through said pulley, said uphaul line passes along periphery of said first end of said rudder, and a lower end of said uphaul line is fixed to said rudderpost;

wherein said second end of said at least one compressible resistance members is attached to said first edge periphery of said first end of said rudder such that said second end of said at least one compressible resistance members is oriented generally to a rearward position facing away from said hull of said boat when said rudder is in said generally down position;

wherein pulling said uphaul line causes rotation of said rudder from said generally down position to an intermediate and generally horizontal position; this movement causes said second end of said at least one compressible resistance members attached to said first edge periphery of said first end of said rudder to rise from a rearward position facing away from said hull of said boat to an intermediate zenith position; said intermediate zenith position generally directly above said fastener on which said rudder pivots; wherein this motion, causing the rudder to move from said generally down to said intermediate and generally horizontal position requires compression of one or more said compression resistance members as said second end of one or more compression resistance members rises from said rearward facing position to said intermediate zenith position;

wherein movement of said rudder from said intermediate and generally horizontal position to said generally up position, causes said second end of said at least one compressible resistance members attached to said first edge periphery of said first end of said rudder to drop from said intermediate zenith position to a forward facing position between said first end of said rudder and said hull of said boat, this movement caused by decompression of said at least one compressible resistance members;

wherein pulling said uphaul line causes rotation of said rudder from said generally up position to said intermediate and generally horizontal position; this movement causes said second end of said at least one compressible resistance members attached to said first edge periphery of said first end of said rudder to rise from said forward facing position between said first end of said rudder and said hull of said boat to said intermediate zenith position; said intermediate zenith position generally directly above said fastener on which said rudder pivots; wherein this motion, causing the rudder to move from said generally up position to said intermediate and generally horizontal position requires compression of one or more said compression resistance members as said second end of one or more compression resistance members rises from said forward position between said first end of said rudder and said hull of said boat to said intermediate zenith position directly above said fastener on which said rudder pivots;

wherein movement of said rudder from said intermediate and generally horizontal position to said generally down position, causes said second end of said at least one compressible resistance members attached to said first edge periphery of said first end of said rudder to drop from said intermediate zenith position to said rearward position facing away from said hull of said boat, this movement caused by decompression of said at least one compressible resistance members;

wherein mounting of said retractable rudder system may be facilitated on either said rearward or said forward portions of said boat.

16. A retractable boat rudder system for a boat, said boat comprising a hull with a bow or forward portion, stern or rearward portion, transom, and steering interface said retractable rudder system comprising:

a rudder with a first end and a second end, said rudder comprised of an elongate planar member containing a pivot hole in the first end of said rudder; said rudder having a first edge and a second edge; said first edge facing rearward from said boat and said second edge facing forward and adjacent to said hull of said boat when rudder resides in a generally down position;

one or more mounting bearings, said mounting bearings configured to attach to said boat with fasteners;

a rudderpost, said rudderpost oriented generally parallel to the transom of said boat, a forward facing portion of said rudderpost attached to said one or more mounting bearings, said mounting bearings allowing a left and right motion of said rudderpost with said rudderpost attached to said steering interface;

one or more of rudder brackets attached to said rudder post, said one or more rudder brackets extending generally rearward, said one or more rudder brackets having pivot holes corresponding to said pivot hole of said rudder;

a fastener passing through said pivot hole of one or more said rudder brackets and said pivot hole in said rudder such that rudder is mounted to said rudder brackets and free to rotate in a plane parallel to a plane of said one or more said rudder brackets;

an uphaul line, an upper end of said uphaul line passing from a top end rudderpost, down said rudderpost, through a pulley fixed to a first edge periphery of said first end of said rudder, and a lower end of said uphaul line being fixed to said rudderpost;

wherein said rudder is configured to move between a said generally down position and a generally up position, movement of said rudder from said generally up position to said generally down position or movement from said generally down position to said generally up position requires pulling said uphaul line;

wherein said pulley is attached to said first edge periphery of said first end of said rudder such that said pulley is oriented generally to a rearward position facing away from said hull of said boat when said rudder is in said generally down position;

wherein pulling said uphaul line causes rotation of said rudder from said generally down position to an intermediate and generally horizontal position; this movement causes said pulley attached to said first edge periphery of said first end of said rudder to rise from a rearward position facing away from said hull of said boat to an intermediate zenith position; said intermediate zenith position generally directly above said fastener on which said rudder pivots;

wherein movement of said rudder from said intermediate and generally horizontal position to said generally up position, causes said pulley attached to said first edge periphery of said first end of said rudder to drop from said intermediate zenith position to a forward facing position between said first end of said rudder and said hull of said boat;

wherein loosening said uphaul line allows rotation of said rudder from said generally up position to said intermediate and generally horizontal position; this movement causes said pulley attached to said first edge periphery of said first end of said rudder to rise from said forward facing position between said first end of said rudder and said hull of said boat to said intermediate zenith position; said intermediate zenith position generally directly above said fastener on which said rudder pivots;

wherein movement of said rudder from said intermediate and generally horizontal position to said generally down position, causes said pulley attached to said first edge periphery of said first end of said rudder to drop from said intermediate zenith position to said rearward position facing away from said hull of said boat.

* * * * *